US005514059A

United States Patent [19]

Romney

[11] Patent Number: 5,514,059

[45] Date of Patent: May 7, 1996

[54] EXERCISE DEVICE FOR UPPER BODY MUSCLES AND SAFETY CHORD

[75] Inventor: Jan W. Romney, Salt Lake City, Utah

[73] Assignee: PowerFlex, Inc., Salt Lake City, Utah

[21] Appl. No.: 387,102

[22] Filed: Feb. 10, 1995

[51] Int. Cl.[6] ..... A63B 21/02

[52] U.S. Cl. ..... 482/124; 482/121; 482/126; 482/74

[58] Field of Search ..... 482/121, 122, 482/124, 126, 74

[56] References Cited

U.S. PATENT DOCUMENTS

| | | | |
|---|---|---|---|
| 1,402,179 | 1/1922 | Piscitelli . | |
| 1,432,013 | 10/1922 | Blake . | |
| 4,026,549 | 5/1977 | Gunn . | |
| 4,335,875 | 6/1982 | Elkin . | |
| 4,441,707 | 4/1984 | Bosch . | |
| 4,540,173 | 9/1985 | Hopkins, Jr. . | |
| 4,691,917 | 9/1987 | Battista . | |
| 5,141,223 | 8/1992 | Block . | |
| 5,186,701 | 2/1993 | Wilkinson | 482/124 |
| 5,234,395 | 8/1993 | Miller et al. . | |
| 5,328,432 | 7/1994 | Gvoich . | |

*Primary Examiner*—Lynne A. Reichard
*Attorney, Agent, or Firm*—Workman, Nydegger & Seeley

[57] ABSTRACT

An elastic exercise device which provides varying resistance to exercise to enable a user to adjust the resistance depending on the strength of the muscles being exercised. The resistance to exercise is varied by selectively adjusting and securing the length of a resistance member. The present invention is directed to a flexible host member carrying a resistance member. The resistance member has an adjustment section which extends along at least length of the flexible host member and is accessible for adjustment. A securing member is attached to the adjustment section, whereby the length of the resistance member is secured alter being adjusted. The length of the resistance member is shortened by accessing the adjustment section of the resistance member, drawing a loop portion of the adjustment section, wrapping the loop portion around or against the flexible member, wrapping the securing member around the flexible member and then fastening the securing member. The length of the resistance member is increased by reversing the procedure.

15 Claims, 4 Drawing Sheets

EXERCISE DEVICE FOR UPPER BODY MUSCLES AND SAFETY CHORD

BACKGROUND OF THE INVENTION

1. The Field of the Invention

The invention relates generally to a general physical conditioning or a physical rehabilitation device. More particularly, the invention relates to an elastic, flexible, and portable exercise device for exercising upper body muscles which is capable of providing varying amounts of resistance to a user, thereby enabling a user to adjust the resistance depending on the strength of the muscles being exercised.

2. Background Art

Elastic, flexible and portable exercising devices are generally inexpensive, convenient to use, and are useful for physical conditioning, particularly in exercising upper body muscles. An elastic exercising device provides resistance against which the user exerts force during exercising.

Many elastic exercising devices provide only constant resistance which limits such devices to being used to exercise only particular muscles or groups of muscles. Additionally, such devices which provide only constant resistance eventually fail to challenge a user as the user's strength increases.

Attempts have been made to provide varying resistance in elastic exercising devices thereby enabling a user to tailor the resistance to meet the need of the muscles being exercised. Many of these devices, however, utilize friction between adjacent, moving or sliding parts to vary the resistance in the device which causes the device to eventually fail or wear out.

Some of these devices are operable only when properly attached to certain portions of the user's body. Other devices are anchored in limited positions relative to a particular body part of a user, such as being looped around the waist or forearm of a user. Devices which are securely attached to or anchored on or about a body part do not require the user to exert a balanced or equal movement. That is, because the device is held in place, the user's conditioning or rehabilitation may not be balanced because the weaker muscle on one side of the body is not exercising against another muscle on the other side of the body, but is merely exercising instead against the fixed, stationary device. This results in an unbalanced work out or therapy.

Additionally, the resistance in some devices can only be made by adjusting the length of the elastic member at the handles of the device. This tends, however, to be cumbersome, particularly when any components of the device dangle from the handles.

Another problem with many of these device is the inability to readily and quickly vary the resistance because of complicated construction. Most of these devices have complicated designs and are therefor expensive to manufacture.

In addition, all exercise devices using an elastic member do not provide a safety mechanism in the event the elastic member breaks or is accidentally severed. If the elastic breaks or is accidentally severed, the user may loose his balance and fall, or the user may inadvertently strike nearby objects injuring the user and nearby objects. Still further, if the elastic member breaks, it may fling itself about injuring the user, others or nearby objects.

From the foregoing, it will be appreciated that what is needed in the art is an exercising device which enables a user to vary resistance without relying on friction between adjacent, moving or sliding parts to vary the resistance. An elastic exercise device is also needed which enables a user to vary resistance without requiring the device to be attached to or otherwise anchored to a particular body part of a user. It would also be an advance to provide or which does not necessarily require adjustment at the handles of the device. Additionally, an elastic exercising device is needed which can be quickly adjusted, has a simple design and is relatively inexpensive to manufacture. It would also be an advance to have an exercise device with a safety chord to prevent any injuries or damage caused if elastic members break or are accidentally severed.

SUMMARY AND OBJECTS OF THE INVENTION

It is an object of this invention to provide an elastic exercising device which enables a user to vary the resistance of the device without relying on friction between adjacent, moving or sliding pans to vary the resistance.

It is also an object of this invention to provide an elastic exercising device which enables a user to vary resistance without requiring the device to attached to or anchored on or about or relative to a particular body pan of a user. This also permits to user to experience balanced conditioning or therapy by working opposing muscle groups against each other instead of merely against an anchored device.

An additional object of this invention is to provide an elastic exercising device which does not necessarily require adjustment at the handles of the device to vary the resistance of the elastic exercising device.

A further object of this invention is to provide an elastic exercising device which enables a user to readily and quickly vary the resistance of the device.

A further object of this invention is to provide a safety mechanism for elastic member in the event they break or are severed.

Finally, it is an object of this invention to provide an elastic exercising device which has a simple design which permits ease of replacing or substituting elastic member and which is relatively inexpensive to manufacture.

The features of the invention are hereinbelow summarized which achieve the foregoing objects in accordance with the invention as embodied and broadly described herein. One feature of the invention is a flexible host member having a first end and a second end. The flexible host member is constructed of or protected by cushioned material to provide comfort to the use. The flexible host member defines a lumen or passageway which extends the length or parts of the length of the flexible host member.

An additional feature of this invention is a resistance member. The resistance member has a first end, a second end, and a length between the first and second ends. Along the length of the resistance member is an adjustment section of the resistance member. The resistance member is removably disposed within the lumen or passageway within the flexible host member such the first end and the second end of the resistance member extend beyond the respective end of the flexible host member. The present invention also contemplates the use of one or more resistance members inside a single, lumen or passageway. The first end of the resistance member terminating at a first handle and the second end of the resistance member terminating at a second handle. In the preferred embodiment, the resistance member is tubular in construction defining a lumen or passageway inside the resistance member the length of the resistance member.

A further feature of the present invention is a means for selecting or varying the length of the resistance member. The selecting means comprises a mechanism which permits the user to electively shorten or increase the length of the resistance member along the adjustment section of the resistance member. The length of the resistance member is shortened by accessing the adjustment section of the resistance member and looping a portion of the adjustment section of the resistance member in the lumen or passageway. The selecting means further comprises a securing member attached to, about or near the adjustment section of the resistance member or the flexible host member permitting the user to releasably secure or fix the selected loop and hence the length of the resistance member. The length of the resistance member is increased by making the loop of the adjustment section of the resistance member smaller or doing away with the loop altogether. Accordingly, the overall length of the available resistance member remains constant while the length of the sections of the resistance member which are subject to tension on both sides of the loop is adjustable.

Another feature of the present invention is a safety chord. The safety chord is also elastic. The safety chord is placed within the lumen or passageway of at least one of the preferred resistance members. In the event that the resistance member breaks or is severed, the safety chord acts as a backup resistance member, thereby avoiding the any sudden imbalance of the user or any attendant injury to the user or others persons or objects nearby caused by whipping or flipping of the severed resistance member.

The exercise device can be safely and comfortably placed around, on or against any body part of the user while the handles are gripped and pushed or pulled. The upper body muscles of a user are exercised due to the resistance encountered by pushing or pulling on the handles to stretch the resistance member or by allowing the resistance member to retract after being stretched. The flexible host member protects the user from the nominal stretching and retracting of the resistance member along its length and from the pressure applied to body parts resulting from the use of the elastic exercise device. Because the exercise device of the present invention is preferably not attached or anchored to the body, it encourage the forces being exerted on the handles of the device to be substantially equal achieving a balanced workout or therapy. The ability of the elastic exercise device to provide varying amounts of resistance to a user enables a user to adjust the resistance depending on the strength of the muscles being exercised. The ability to vary resistance also enables a user to tailor exercises as the strength of a particular muscle or muscle group changes.

One advantage of this invention is that a user can vary the resistance of the device without relying on friction between adjacent moving or sliding parts because the resistance is varied by changing the length of the portions of the resistance member which are subject to tension as a user exercises.

Another advantage of this invention is the ability to vary resistance of the invention without requiring the invention to be anchored or in limited positions relative to a particular body part of a user, such as being secured around the waist or specifically designed or constructed to be compatible with an arm or leg of the user.

An additional advantage of this invention is the ability to vary the resistance of the elastic exercise device without any adjustment at the handles of the device.

A further advantage of this invention is the ability to quickly vary the resistance of the elastic exercising device.

Still another advantage is the ability to ensure a balance workout or therapy.

Yet another advantage is the injury and damage prevention ensured by the safety chord within the preferred resistance member.

Another advantage is the ready removability, interchangeability or replacement of resistance member to meet the desired resistance needs of the user.

Finally, additional advantages of this invention are the simple design of the elastic exercising device and the low cost of manufacturing the elastic exercise device as the device comprises only a few components and all of the components are made from inexpensive materials.

These and other objects, features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
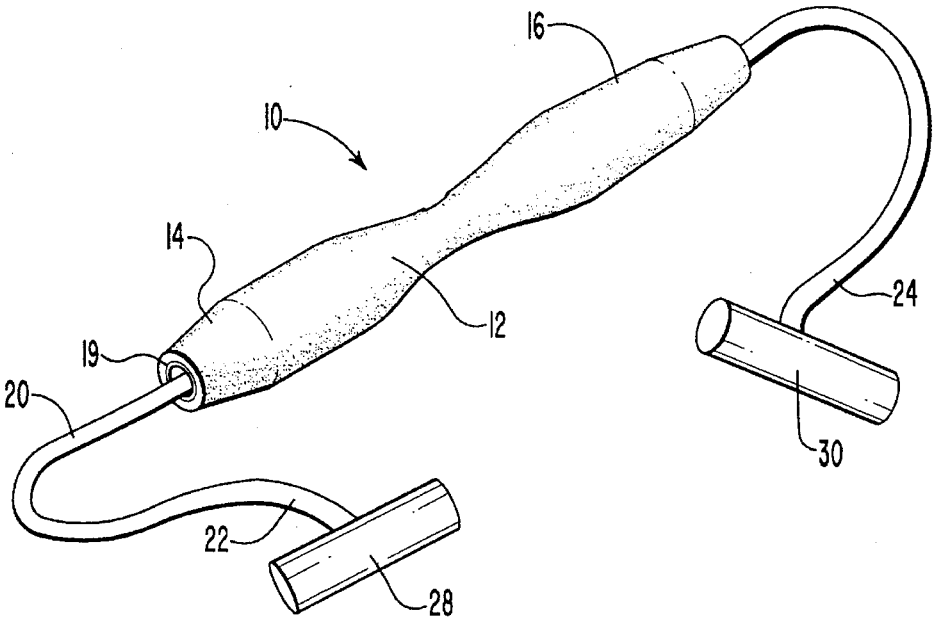
FIG. 1 is a perspective view of the elastic exercise device with the length of resistance member fully extended.
Figure 2:
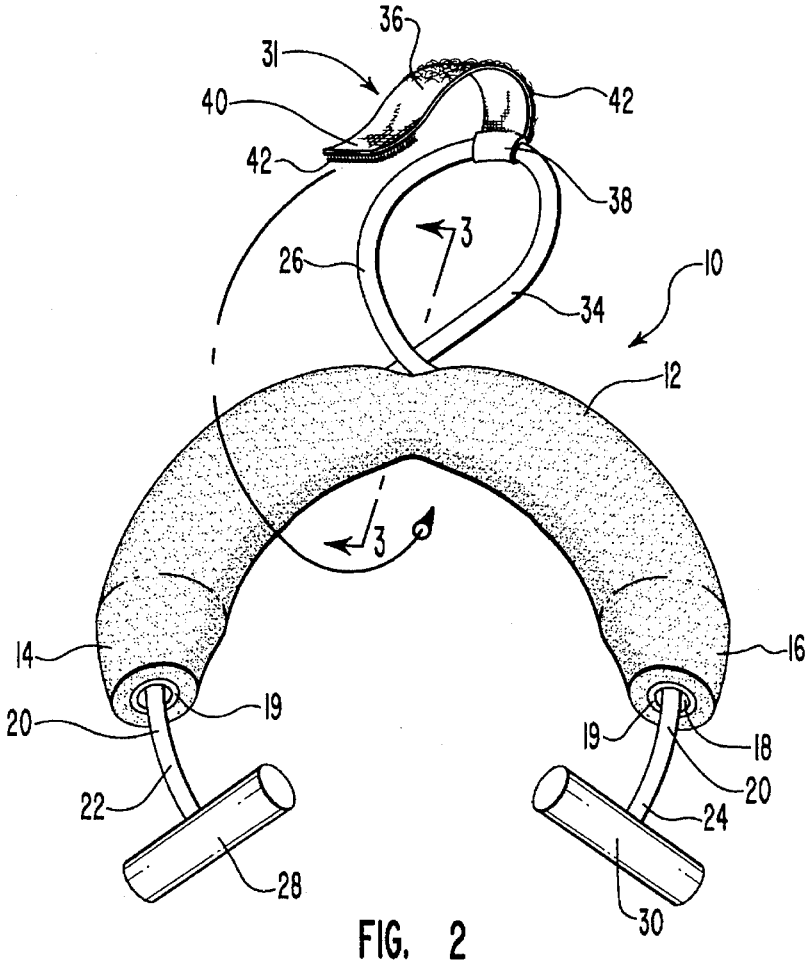
FIG. 2 is a perspective view of the elastic exercise device with the length of resistance member adjusted.

In FIG. 1, an elastic exercise device for upper body muscles is shown generally at 10 in accordance with the present invention, see also FIG. 2. Exercise device 10 comprises a flexible host member 12 having a first end 14 and a second end 16. In the preferred embodiment, flexible host member 12 is tubular and is made of or is protected by a foam pad material to provide cushioning. Flexible tubular member 12 can also be formed of any material which is flexible, such as soft rubber.

As shown in FIG. 2, flexible tubular member 12 defines a lumen or passageway 18 substantially axial to member 12. Lumen 18 extends at least a length of flexible tubular member 12. A resistance member 20 is removably disposed in lumen 18. Resistance member 20 has a first end 22 and a second end 24. Resistance member 20 also has an adjustment section 26 extending from first end 14 of flexible tubular member 12 to second end 16 of flexible tubular member 12 through lumen 18, adjustment section 26 being integral with and between the first end 22 of resistance member 20 and second end 24 of resistance member 20. The resistance member 20 is constructed of a material which permits resistance member 20 to be flexible so it can be stretched or bent. For example, resistance member 20 can be constructed of surgical tubing, or any other tubing whose physical properties are consistent with the structural and functional characteristics of the present invention. For example, resistance member 20 may be constructed of any durable polymeric material. It is also contemplated that in some embodiments, resistance member 20 could be flat rather than tubular.

Figure 7:
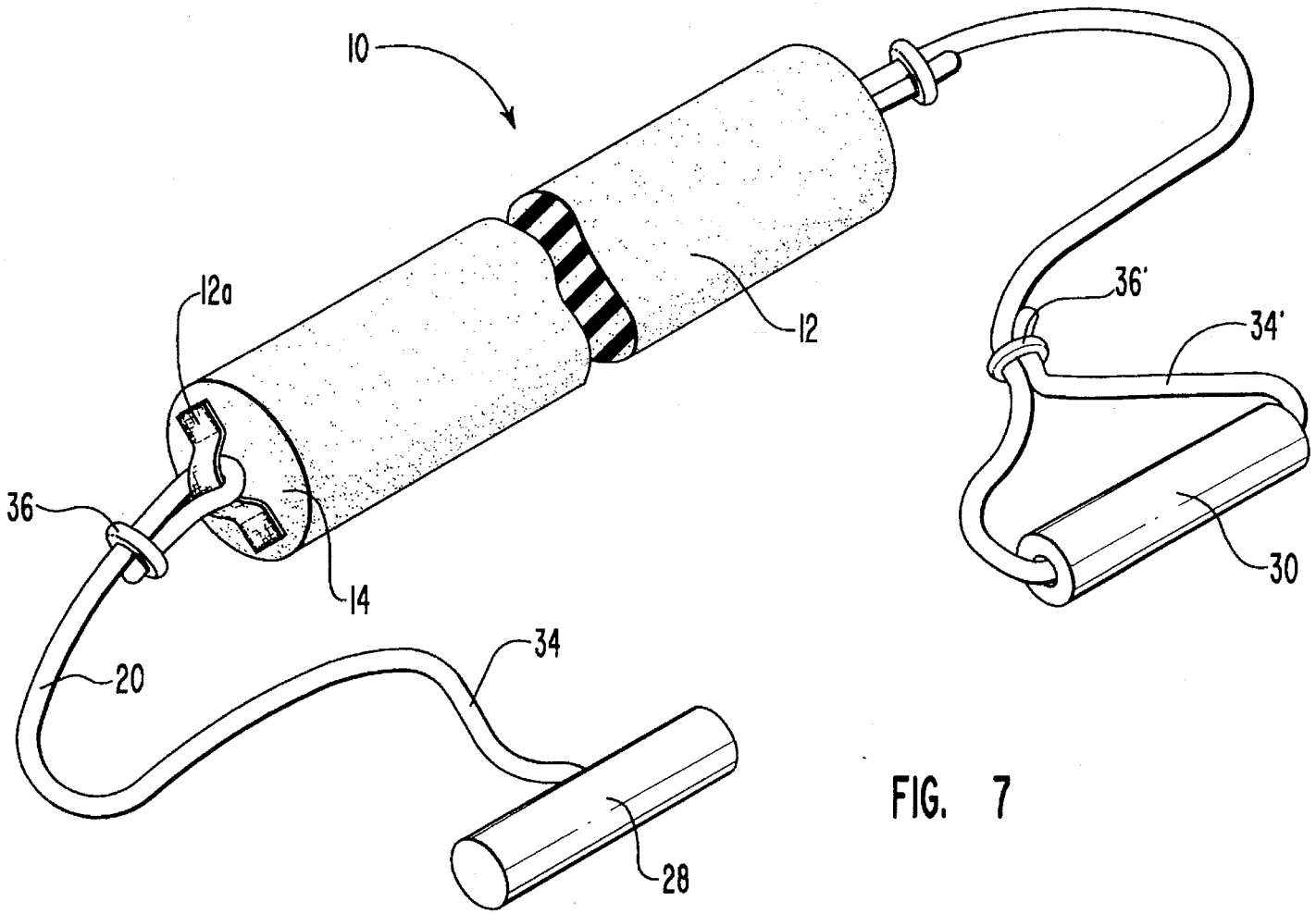
FIG. 7 depicts an alternative embodiment of the present invention.

First end 22 of resistance member 20 terminates at a first handle 28 and second end 24 of resistance member 20 terminates at a second handle 30. Handles 28 and 30 in the preferred embodiment are releasably attached to the respective ends of resistance member 20 as shown in FIGS. 1 and 2 and may be formed in any suitable manner. Handles 28 and 30 can also incorporate loops of resistance member 20 which are held in the position of a loop by a fixed or releasable knot or securing member, as shown in FIG. 7, or a crimped metal band. The preferred construction of handles 28 and 30 are of a soft material. This has the advantage of preventing injury or damage if a handle were to slip out the user's hand while exercising and strike the user or other persons or objects nearby. The preferred embodiment of the present invention releasably attaches handles 28 and/or 30 to resistance member 20 so they may be readily removed if the user wishes to replace the resistance member 20. Replacement may also be desired if resistance member 20 breaks, or if the user wishes to use a heavier or lighter resistance member in the device. In the preferred embodiment, while resistance member 20 is detachably connected to handles 28 and 30, no configuration of handles 28 and 30 in the preferred embodiment is contemplated for adjusting of the length of resistance member 20 at the handles. However, in another embodiment, discussed below, a configuration is contemplated which would, as an optional feature, also permit adjustment of the length of the resistance member at the handles.

Exercise device 10 can be placed on, against or around any body part of the user, for example one's neck, back, waist or other body part. In any use, handles 28 and 30 are gripped and pushed or pulled. Flexible member 12 protects a user from the nominal axial stretching, bending or retracting of resistance member 20 and from the pressure applied to body parts resulting from the use of exercise device 10. Stretching or bending resistance member 20 provides resistance to exercise as a user pulls on handles 28 and 30. Allowing resistance member 20 to retract after it has been stretched or bent can also provide further resistance. The resistance provided by resistance member 20 enables a user to exercise the upper body muscles, or other body parts. It is contemplated that obvious variations of this device could be used for foot, knee or other extremity conditioning or therapy. A preferred construction would be to include a lumen liner 19 to prevent the nominal stretching of resistance member 20 from compromising the integrity of cushioned tubular member 12. Lumen liner 19 may be substantially coextensive with lumen 18, or liner 19 may protect a portion of member 12 at openings at first end 14, second end 16 and/or access port 32 (discussed below).

Figure 3:
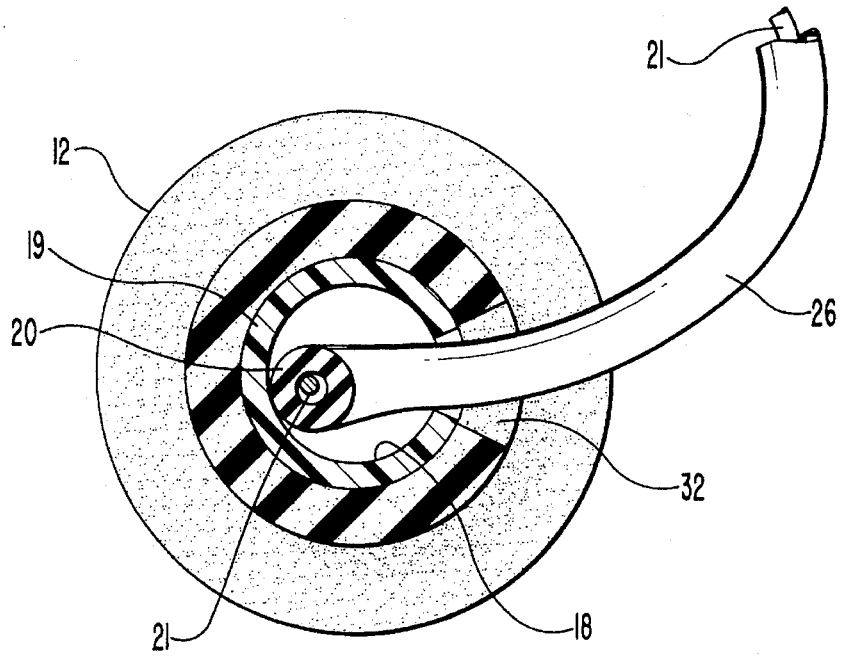
FIG. 3 is a longitudinal cross section of the elastic exercise device taken along cutting plane line 3—3 of FIG. 2.

The resistance generated by exercise device 10 is varied by means for selecting the length of resistance member 20, whereby a user can selectively adjust and releasably secure the length of resistance member 20. The preferred embodiment utilizes the means for selecting the length of resistance member 20, illustrated in FIGS. 1–4. The length of resistance member 20 is shown fully extended in FIG. 1. FIG. 2 is a perspective view of exercise device 10 after the length of resistance member 20 has been adjusted. The selecting means of FIGS. 1–4 comprises an access port 32. FIG. 3, which is a longitudinal cross section of the exercise device taken along cutting plane line 3—3 of FIG. 2, depicts access port 32 being in communication with lumen 18 and being located along the length of flexible tubular member 12 between first end 14 of flexible tubular member 12 and second end 16 of flexible tubular member 12.

Adjustment section 26 of resistance member 20 has a portion which is accessible through the means for selecting the length of resistance member 20. To adjust the length of resistance member 20, a length or loop of resistance member 20 is drawn out of access port 32. Varying the length of loop 34 varies the length of resistance member 20, more particularly the length of resistance member 20 which is subjected to stretching and bending as a user pulls handles 28 and 30. Accordingly, the length of resistance member 20 which is subject to stretching or bending as a user exercises can be varied while the overall length of resistance member 20 remains constant.

The selecting means further comprises a means for releasably securing the selected length of resistance member 20. The securing means in the preferred embodiment comprises a securing member 31 attached to or about adjustment section 26 of resistance member 20. One construction of securing member 31 comprises a strip 36 having a proximal end 38 and a distal end 40, proximal end 38 being attached to adjustment section 26, or to flexible member 12, not shown. Strip 36 also has one or more attachment members 42 fixedly secured to strip 36. Proximal end 38 can be attached to or about adjustment section 26 as desired or needed. Proximal end 38 can also be fixedly attached to resistance member 26, even rotatably attached to resistance member 20, to enhance the ability of strip 36 to be wrapped around flexible tubular member 12. Proximal end 38 may, in another construction, be slidably attached to adjustment section 26 to allow proximal end 38 to be attached to adjustment section 26 at a point other than the midpoint of resistance member 20 and thereby provide unequal resistance as a user pulls on handles 28 and 30.

The attachment member(s) 42 of strip 36 is/are preferably a set of hook and loop attachment members 42. Strip 36 is preferably constructed of lycra. The set of hook and loop attachment members 42 is preferably a set of Velcro® attachment members attached at opposite ends of strip 36. Attachment members 42, however, can be any mechanism, such as snaps, buckles, catches, etc. which will interlock thereby permitting strip 36 to be releasably secured around or against flexible member 12.

Figure 4:
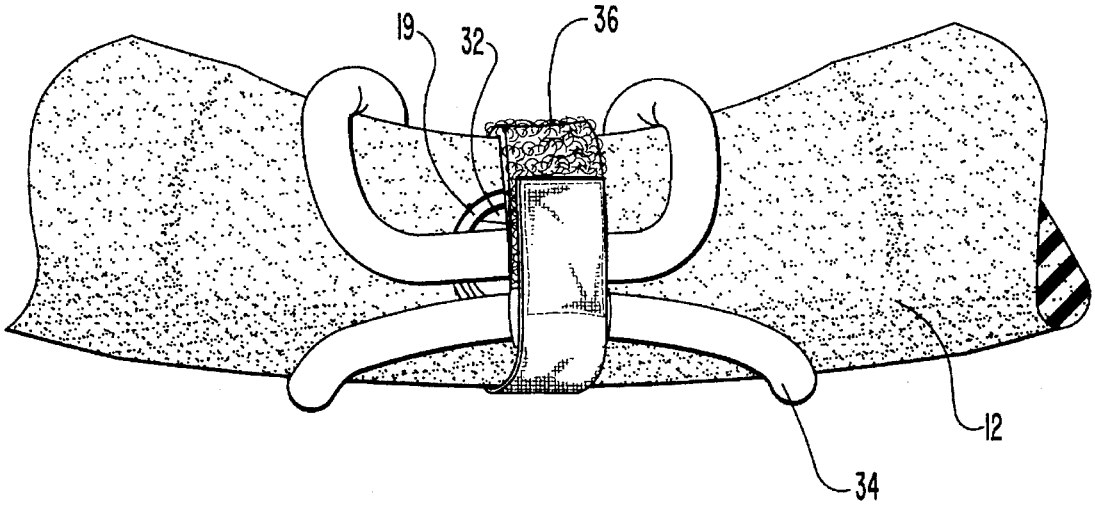
FIG. 4 is an enlarged perspective view of the flexible tubular member after the length of the resistance member has been selected.

As shown in FIG. 4, the length of adjustment section 26 has been selected. The length of resistance member 20 is selected by accessing adjustment section 26 of the resistance member 20 in lumen 18 through the access port 32, drawing a portion of adjustment section 26 out of lumen 18 through the access port 32 to form loop 34, wrapping loop 34 around flexible tubular member 12, wrapping securing member 31 around flexible tubular member 12 and then fastening set of hook and loop attachment members 42 together to secure strip 36. The length of resistance member 20 is increased by pulling on handles 28 and 30 after the securing member 31 has been released. The selecting means enables a user to quickly vary the resistance of resistance member 20 and to subsequently use exercise device 10 without being impeded or bothered by any dangling parts. In the preferred embodiment, the portion of flexible member 12 around which loop 34 is wrapped is tapered to accommodate loop 34 thereby avoiding any discomfort to the user.

The ability to vary the resistance of exercise device 10 enables a user to adjust the resistance depending on the strength of the muscles being exercised. Additionally, the ability to vary resistance enables a user to tailor exercises as the strength of a particular muscle or muscle group changes. Exercise device 10 also enables a user to selectively increase the tension of the exercise device by readily shortening or lengthening the length of resistance member 20 without having to fuss with buckles or adjusting the length of resistance member 20 at or near the handles. To the contrary, in the preferred embodiment, all adjustment is done remote from the handles and in a fashion described above. Furthermore, resistance member 20 can be removed altogether and a heavier or light resistance member can be installed.

Technically, the selecting means within the scope of the present invention includes any mechanism which selects the length of resistance member 20, while being in communication with lumen 18 and located along the length of flexible member 12 between the first end 14 of flexible member 12 and second end 16 of flexible member 12. In the preferred embodiment of the present invention the selecting means comprises access port 32. The shape of access port 32 in the preferred embodiment is substantially circular as shown in FIGS. 1–4 but could be any shape safely compatible with accessing resistance member 20.

Figure 5:
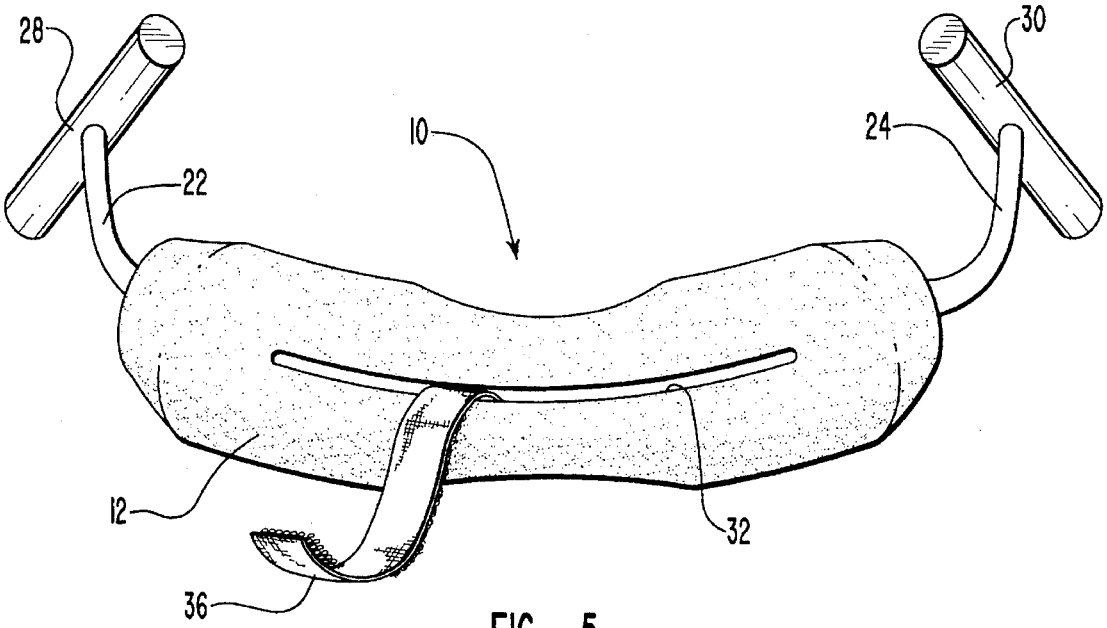
FIG. 5 depicts an alternative embodiment of the present invention.

However, in other embodiments, the selecting means can also be a plurality of access ports. Additionally, the selecting means can be an access port having any shape. For example, the access port can be a slit extending along the length of flexible tubular member 12, see FIG. 5.

Figure 6:
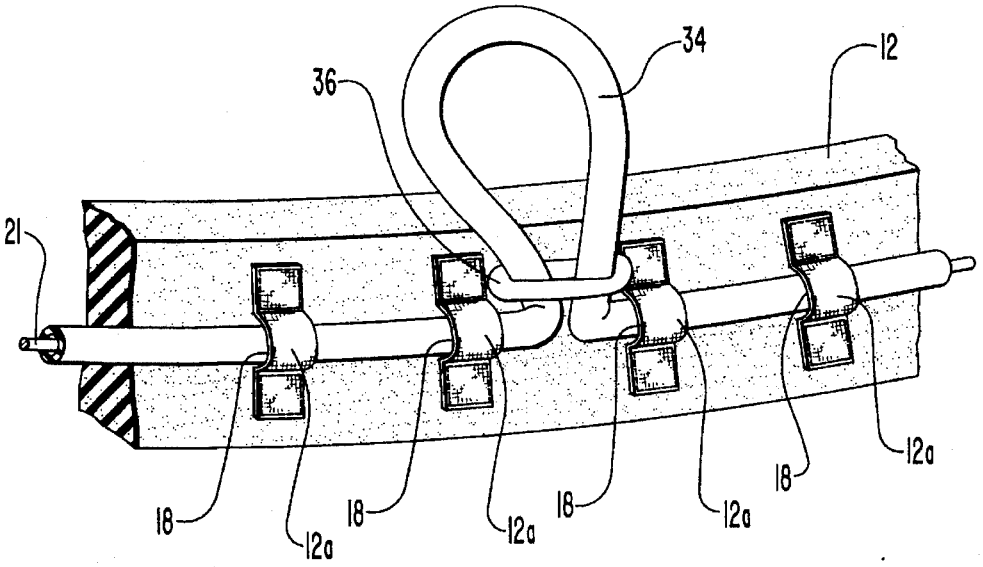
FIG. 6 depicts an equivalent embodiment of the present invention employing a flexible flat host member.

An alternative embodiment of the present invention is shown in FIG. 6. In FIG. 6, flexible member 12 is flat, that is, nontubular, and is adapted with eyelets 12*a* which define a lumen or passageway 18 along at least a length of member 12. Resistance member 20 is disposed in lumen 18. At the desired location, a loop 34 of resistance member 20 can be made and secured by member 36 is a similar or equivalent fashion discussed above. Again, device 10 is not anchored to the body, thereby encouraging a balanced workout or therapy.

Another embodiment of the present invention is depicted in FIG. 7. In FIG. 7, adjustment of resistance member 20 also occurs remote from handle 28 at end 14 of flexible member 12. Again, flexible member 12 can be adapted with an eyelet 12*a* to receive resistance member 20. Selective adjustment of the length of resistance member 20 is again accomplished by forming a loop 34 and employing a means for securing loop 34, such as securing it with member 36.

If desired, an additional loop 34' can be added at the handle as shown is association with handle 30 in FIG. 7. Consequently, additional securing member 36' would be utilized. This would provide the user an additional option of further adjustment at the handles if desired.

All of the embodiments discussed above and any other exercise equipment using flexible or stretchable cords or bands may be further enhanced with a safety chord 21 shown in FIGS. 3 and 6. Safety chord 21 is designed to prevent any injury to the user, others or objects nearby in the event resistance member 20 breaks or is severed. In the preferred embodiment, safety chord 21 is sufficiently elastic so as to stretch as needed. It is also contemplated that safety chord 21 may be inelastic if sufficient length of chord were available to accommodate stretching of resistance member 20. Safety chord 21 is disposed in the lumen of resistance member 20. It is also contemplated that lumen 18 could receive and carry more than one resistance member, any one of which could act as a safety chord. Safety chord 21 acts as a catch to prevent the resistance member 20 from errantly flailing about if severed or broken thereby preventing harm or damage to the user and other persons or objects nearby.

In the preferred embodiments, device 10 is not anchored to the body of the user, thereby encouraging an equal or balanced workout. However, the present invention could further comprise means for anchoring the device 10 to the body of the user such as affixing device 10 to a belt which is secured about the user, or by providing flexible member 12 with catches or clamps to hold member 12 in place about the user. The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise device comprising:

a flexible host member having a length, a first end, and a second end, the flexible host member defining a lumen along at least a length of the flexible host member;

a resistance member having a length, a first end, a second end and an adjustment section along the length of the resistance member, the adjustment section being integral with and between the first end of the resistance member and the second end of the resistance member, the resistance member constructed of a material such that the resistance member is elastic, the resistance member disposed within the lumen of the host member, the first end of the resistance member terminating at a first handle, the second end of the resistance member terminating at a second handle; and means for selecting the length of the resistance member to provide varying resistance to exercise, the selecting means positioned along the length of the flexible host member between the first end and the second ends of the flexible host member.

2. An exercise device as defined in claim 1, wherein the means for selecting the length of the resistance member comprises an accessible adjustment section of the resistance member, a length of the adjustment section capable of being fashioned in a loop, and means for releasably securing the size of the loop.

3. An exercise device as defined in claim 2, wherein the flexible host member is tubular defining the lumen substantially axially along a length of the flexible tubular host member.

4. An exercise device comprising:

a flexible host member having a length, a first end, and a second end, wherein the flexible host member is tubular defining a lumen substantially axially along a length of the flexible host member;

a resistance member having a length, a first end, a second end and an adjustment section along the length of the resistance member, the adjustment section being integral with and between the first end of the resistance member and the second end of the resistance member, the resistance member constructed of a material such that the resistance member is elastic, the resistance member disposed within the lumen of the host member, the first end of the resistance member terminating at a first handle, the second end of the resistance member terminating at a second handle; and means for selecting the length of the resistance member to provide varying resistance to exercise, the selecting means positioned along the length of the flexible host member between the first end and the second ends of the flexible host member and the selecting means comprising an accessible adjustment section of the resistance member, a length of the adjustment section capable of being fashioned in a loop, and means for releasably securing the size of the loop the means for releasably securing the size of the loop further comprising at least one access port in the flexible tubular host member in communication with the lumen of the flexible tubular host member and located along the length of the flexible tubular host member between the first end and the second end of the flexible tubular member.

5. An exercise device as defined in claim 4, wherein the flexible tubular member is tapered radially inward at substantially the midpoint between the first end and second end of the flexible tubular member, at the first end and at the second end of the flexible tubular member.

6. An exercise device as defined in claim 2, wherein the flexible host member is substantially flat and has one or more eyelets defining the lumen along at least a length of the flexible flat host member.

7. An exercise device as defined in claim 2, wherein the means for releasably securing the sized of the loop of the resistance member comprises a securing member having a proximal end and a distal end, the securing member capable of releasably fixing the size of the loop of the resistance member.

8. An exercise device comprising:

a flexible host member having a length, a first end, and a second end, the flexible host member defining a lumen along at least a length of the flexible host member;

a resistance member having a length, a first end, a second end and an adjustment section along the length of the resistance member, the adjustment section being integral with and between the first end of the resistance member and the second end of the resistance member, the resistance member constructed of a material such that the resistance member is elastic, the resistance member disposed within the lumen of the host member, the first end of the resistance member terminating at a first handle, the second end of the resistance member terminating at a second handle; and means for selecting the length of the resistance member to provide varying resistance to exercise, the selecting means positioned along the length of the flexible host member between the first end and the second ends of the flexible host member and the selecting means comprising an accessible adjustment section of the resistance member, a length of the adjustment section capable of being fashioned in a loop, and means for releasably securing the size of the loop comprising a securing member having proximal end and a distal end, the securing member capable of releasably fixing the size of the loop of the resistance member and the proximal end of the securing member is fixedly attached to the adjustment section at substantially the midpoint of the resistance member.

9. An exercise device comprising:

a flexible host member having a length, a first end, and a second end, the flexible host member defining a lumen along at least a length of the flexible host member;

a resistance member having a length, a first end, a second end and an adjustment section along the length of the resistance member, the adjustment section being integral with and between the first end of the resistance member and the second end of the resistance member, the resistance member constructed of a material such that the resistance member is elastic, the resistance member disposed within the lumen of the host member, the first end of the resistance member terminating at a first handle, the second end of the resistance member terminating at a second handle; and means for selecting the length of the resistance member to provide varying resistance to exercise, the selecting means positioned along the length of the flexible host member between the first end and the second ends of the flexible host member and the selecting means comprising an accessible adjustment section of the resistance member, a length of the adjustment section capable of being fashioned in a loop, and means for releasably securing the size of the loop comprising a securing member having proximal end and a distal end, the securing member capable of releasably fixing the size of the loop of the resistance member and the proximal end of the securing member is slidably attached to the adjustment section.

10. An exercise device as defined in claim 9, wherein the securing member further comprises at least two attachment members along the length of the securing member, one attachment member capable of releasably receiving the other attachment member.

11. An exercise device as defined in claim 9, wherein the securing member is constructed of lycra.

12. An exercise device as defined in claim 1, wherein the flexible member is formed of a foam pad material.

13. An exercise device as defined in claim 1 wherein the resistance member is tubular defining a lumen substantially axially along the length of the resistance member, the exercise device further comprising a safety chord disposed within the lumen of the resistance member.

14. An exercise device comprising:

a elastic cord member having a first end and a second end, the elastic cord having a substantially tubular construction defining a lumen along the axial length of the cord member;

a safety chord disposed within the lumen of the cord member; and exercise equipment which employs the elastic cord member to provide resistance against which the user exercises.

15. An exercise device comprising:

a flexible host member having a length, a first end, and a second end;

a first resistance member having a length, a first end, a second end and an adjustment section along the length of the first resistance member, the adjustment section being integral with and between the first end and the second end of the first resistance member, the first resistance member constructed of a material such that the first resistance member is elastic, the first end of the first resistance member releasably attached to the first end of the flexible host member, the second end of the first resistance member terminating at a first handle;

a second resistance member having a length, a first end and a second end and an adjustment section along the length of the second resistance member, the adjustment section being integral with and between the first end and the second end of the second resistance member, the second resistance member constructed of a material such that the second resistance member is elastic, the first end of the second resistance member releasably attached to the second end of the flexible host member, the second end of the second resistance member terminating at a second handle; and means for selecting the length of the first and second resistance members, the selecting means positioned at the respective first and second ends of the flexible host member, whereby the adjustment section of the resistance member can be accessed by a user to selectively adjust and releasably secure the length of the resistance member in order to provide varying resistance to exercise.

* * * * *